United States Patent [19]

Fujimoto et al.

[11] Patent Number: 4,945,485

[45] Date of Patent: Jul. 31, 1990

[54] METHOD FOR CONTROLLING THE OPERATION OF AN ENGINE FOR A VEHICLE

[75] Inventors: Takanori Fujimoto; Toshiro Hara, both of Himeji, Japan

[73] Assignee: Mitsubishi Denki Kabushiki Kaisha, Japan

[21] Appl. No.: 254,657

[22] PCT Filed: Feb. 13, 1988

[86] PCT No.: PCT/JP88/00144

§ 371 Date: Sep. 28, 1988

§ 102(e) Date: Sep. 28, 1988

[87] PCT Pub. No.: WO88/06236

PCT Pub. Date: Aug. 25, 1988

[30] Foreign Application Priority Data

Feb. 13, 1987 [JP] Japan ..... 62-32016
Feb. 13, 1987 [JP] Japan ..... 62-32017

[51] Int. Cl.[5] ..... F02D 41/26; F02D 41/40; F02M 51/00

[52] U.S. Cl. ..... 364/431.05; 123/480; 123/492; 364/431.04

[58] Field of Search ..... 364/431.06, 431.03, 364/431.04, 431.05; 123/488, 489, 440, 492, 480, 481, 482, 486; 73/119

[56] References Cited

U.S. PATENT DOCUMENTS

| | | | |
|---|---|---|---|
| 4,255,789 | 3/1981 | Hartford et al. | 364/431.06 |
| 4,282,573 | 8/1981 | Imai et al. | 364/431.05 |
| 4,416,240 | 11/1983 | Matsuoka | 123/492 |
| 4,445,481 | 5/1984 | Aoki et al. | 123/489 |
| 4,573,443 | 3/1986 | Watanabe et al. | 123/492 |
| 4,594,987 | 6/1986 | Wataya et al. | 123/494 |
| 4,683,539 | 7/1987 | Kanno et al. | 364/431.05 |
| 4,706,632 | 11/1987 | Kasanami et al. | 123/492 |
| 4,706,634 | 11/1987 | Nishikawa et al. | 123/492 |
| 4,739,739 | 4/1988 | Wataya et al. | 123/497 |
| 4,751,650 | 6/1988 | Wazaki et al. | 123/492 |
| 4,760,829 | 8/1988 | Kanno et al. | 123/488 |
| 4,773,375 | 9/1988 | Okino et al. | 364/431.05 |
| 4,792,905 | 12/1988 | Sekozawa et al. | 123/480 |

FOREIGN PATENT DOCUMENTS

| | | |
|---|---|---|
| 98631/58 | 3/1972 | Japan . |
| 51146/59 | 8/1981 | Japan . |
| 2058406 | 9/1979 | United Kingdom . |

OTHER PUBLICATIONS

Morris et al., Scamp Microprocessor Aims to Replace Mechanical Logic, Electronics, Sep. 18, 1975, pp. 81–87.

*Primary Examiner*—Felix D. Gruber
*Attorney, Agent, or Firm*—Leydig, Voit & Mayer

[57] ABSTRACT

An engine control method for a vehicle is disclosed in which operation of an engine is optimally controlled in an entire operating range thereof without causing any undesirable delay in control operation. To this end, operating conditions of the engine are sensed through the use of various sensors and control signals are calculated based on the sensed engine operating conditions in a plurality of steps through the use of a microcomputer so that the operation of the engine is optimized by the use of the control signals thus calculated. In one embodiment, a first step and a second step of the plurality of steps are alternately calculated and omitted every other time the control signals are calculated while an operating parameter of the engine operates in a specified operating range in which variations in the sensed operating conditions of the engine are limited. In another embodiment, a third step of the plurality of steps is omitted every other time the control signals are calculated while an operating parameter of the engine operates in the specified operating range in which variations in the sensed operating conditions of the engine are limited.

16 Claims, 4 Drawing Sheets

METHOD FOR CONTROLLING THE OPERATION OF AN ENGINE FOR A VEHICLE

TECHNICAL FIELD

The present invention relates to a method for controlling the operation of an engine mounted on a vehicle, and more particularly, to an engine control method in which the operation of an engine is controlled in an optimal manner by the use of a microcomputer.

BACKGROUND ART

FIG. 1 shows a conventional engine control device for controlling the operation of a fuel injection type engine. In FIG. 1, the engine illustrated comprises an engine proper 1 having a water jacket la formed in an engine block for circulation of a coolant, an intake passage or manifold 1*b* connected with the engine proper 1 for supplying intake air, an exhaust passage or manifold 1*c* connected with the engine proper 1 for discharging exhaust gas to the ambient atmosphere, an air flow sensor 2 for sensing an operating conditioning the flow rate of intake air sucked into the engine proper 1, a crank angle sensor 3 adapted to generate an output signal in synchronization with a predetermined crank angle, i.e., whenever the engine proper 1 takes the predetermined crank angle, a temperature sensor 4 mounted on the engine block for sensing another operating condition the temperature of the engine proper 1, i.e., the temperature of the coolant in the water jacket 1*a*, a control unit 5 connected to receive the output signals from the air flow sensor 2, the crank angle sensor 3 and the temperature sensor 4 for calculating an appropriate fuel injection pulse width based on these output signals and generating an output signal representative of the fuel injection pulse width thus calculated, and a fuel injector 6 disposed in the intake manifold 1*b* and connected to receive the output signal of the control unit 5 for injecting fuel into the intake manifold 1*b* dependent on the control unit output signal.

The control unit 5 has a control program stored therein for controlling the operation of the engine. Specifically, the control unit 5 operates to control the engine in the manner as shown in flow charts of FIGS. 2 and 3. FIG. 2 illustrates a main routine and FIG. 3 a crank angle interrupt routine for executing interrupt processing by means of a crank angle signal (the output signal of the crank angle sensor 3) which is generated by the crank angle sensor 3 in synchronization with the predetermined crank angle of the engine. Referring first to FIG. 2, after an unillustrated ignition switch is turned on to start the engine, the control program stored in the control unit 5 is initialized in Step S301. In Step S302, engine stall processing is executed, and in Step S303, it is determined whether or not the engine is stalled. If so, the process returns to Step S302, and if not, the process proceeds to Step S304 wherein various modification coefficients $K_C$ such as a warm-up modification coefficient which is used for modifying the warm-up operation of the engine are calculated based on various factors representative of engine operating conditions such as the engine temperature as sensed by the temperature sensor 4. Thereafter, the process returns to Step S303.

On the other hand, the crank angle interrupt routine illustrated in FIG. 3 is executed as follows. First, in Step S401, the period between the successive crank angle signals, produced by the crank angle sensor 3 is measured. The period is the time interval between the instant when the engine takes a predetermined crank angle in one engine cycle and the instant when the engine takes that crank angle in the following engine cycle; The results thus obtained are used as a kind of information representing the number of revolutions per minute of the engine. Then, in Step S402, the amount of intake air $Q_n$ sucked into the engine per engine cycle (i.e., the intake air amount sucked between successive crank angle signals or successive intake strokes) is calculated from the output signal of the air-flow sensor 2 which is representative of the flow rate of intake air as sensed, and in Step S403, a basic injection pulse width $\tau$ is calculated so as to determine a basic amount of fuel to be injected which is suited to the interstroke intake air amount $Q_n$ calculated in Step S402. The basic injection pulse width $\tau$ is calculated as follows:

$$\tau = Q_N \times K_G$$

where $K_G$ is a constant which is determined by the pulse width versus fuel injection amount characteristic of the fuel injector 6.

In Step S404, a transitional modification coefficient $K_{ACC}$ for modifying the basic amount of fuel to be injected from the fuel injector 6 during transitional operation of the engine is calculated which is equal to a change $(Q_n - Q_{n-1})$ in the amount of intake air sucked into the engine between the successive engine intake strokes. Then, in Step 405, using the transitional modification coefficient $K_{ACC}$ thus calculated in Step S404, the basic injection pulse width $\tau$ previously determined in Step S403 is subjected to transitional modification to provide a transitionally modified injection pulse width $\tau_1$ which is expressed as follows:

$$\tau_1 = \tau \times K_{ACC}$$

Subsequently, in Step S406, using other various modification coefficients $K_C$ which are calculated in Step S304 of the main routine shown in FIG. 2, the transitionally modified injection pulse width $\tau_1$ is further subjected to other various modifications to provide a finally modified injection pulse width $\tau_2$ which is expressed by the following formula:

$$\tau_2 = \tau_1 \times K_C$$

In Step S407, the control unit 5 operates to output the finally modified injection pulse width $\tau_2$ calculated in the above manner to the fuel injector 6 so that fuel is injected from the fuel injector 6 into the intake passage 1*b* in accordance with the finally modified injection pulse width $\tau_2$.

With the conventional engine control device as described above, various modification coefficients $K_C$ are first calculated in the main routine, and then interstroke intake air amounts (i.e., amount of air) sucked into the engine between successive intake strokes) are calculated in the crank angle interrupt routine whereby the basic injection pulse width $\tau$ is determined based on the interstroke intake air amount and then modified by multiplying it with the transitional modification coefficient $K_{CC}$ and other various modification coefficients $K_C$ to provide a finally modified injection pulse width $\tau_2$ which is output from the control unit 5 to the fuel injector 6 in synchronization with the output signal of the crank angle sensor 3, thereby enabling the engine to operate at a predetermined air/fuel ratio.

Recently, however, various transitional modifications of engine control are required in order to improve engine performance through optimal engine control, i.e., to increase the maximum RPM of the engine for increased maximum output power, improve transition characteristics of the engine and the like. As a result, it is a general trend that engine control becomes more and more complicated and the time required for such modification processings becomes longer year by year. Accordingly, in the past, if the entire processes of the crank angle interrupt routine are executed for every crank angle signal particularly during the high RPM operation of the engine, there would be introduced time lags in operation of the fuel injector 6. Accordingly, the injector 6 could not be operated at optimal timing in synchronization with the output signal of the crank angle sensor 3 so that the time for processing the main routine becomes longer, thus making it difficult for the various modifications to be effectively and timely reflected on the engine control.

DISCLOSURE OF THE INVENTION

The present invention is intended to obviate the above-described problems of the prior art, and has for its object the provision of an engine control method which serves to optimally control the operation of an engine in the entire operating range thereof without causing any undesirable delay in control operation.

In order to achieve the above object, according to one aspect of the present invention, an engine control method for a vehicle comprises the steps of sensing operating conditions of an engine through the use of various sensors, calculating control signals based on the sensed engine operating conditions in a plurality of steps including a step of measuring engine revolution period and a step of measuring interstroke intake air through the use of a microcomputer, optimizing operation of the engine by use of the control signals thus calculated, and alternately calculating and omitting the step of measuring engine revolution speed and the of measuring interstroke intake air every other time the control signals are calculated while the engine operates in a specified operating range in which variations in the sensed operating conditions of the engine are limited.

According to another aspect of the present invention, an engine control method for a vehicle comprises the steps of sensing operating conditions of an engine through the use of various sensors, calculating a fuel injection pulse width based on the sensed engine operating conditions in a plurality of steps including a step of measuring interstroke intake air through the use of a microcomputer, optimizing operation of engine by the use of the fuel injection pulse width thus calculated, wherein the step of measuring interstroke intake air is omitted every other time the fuel injection pulse width is calculated while an operating parameter of the engine operates in a specified operating range of the engine in which variations in the sensed operating conditions of the engine are limited and executed every time the fuel injection pulse width is calculated while the engine operates outside the specified operating range.

The above and other objects, features and advantages of the present invention will become apparent from the following detailed description of a few presently preferred embodiments thereof when taken in conjunction with the accompanying drawings.

BEST MODE FOR CARRYING OUT THE INVENTION

The present invention will now be described in detail by way of example with reference to the accompanying drawings in which the invention is applied so as to control the operation of an engine in the form of a fuel injection type engine having a fuel injector.

Figure 1:
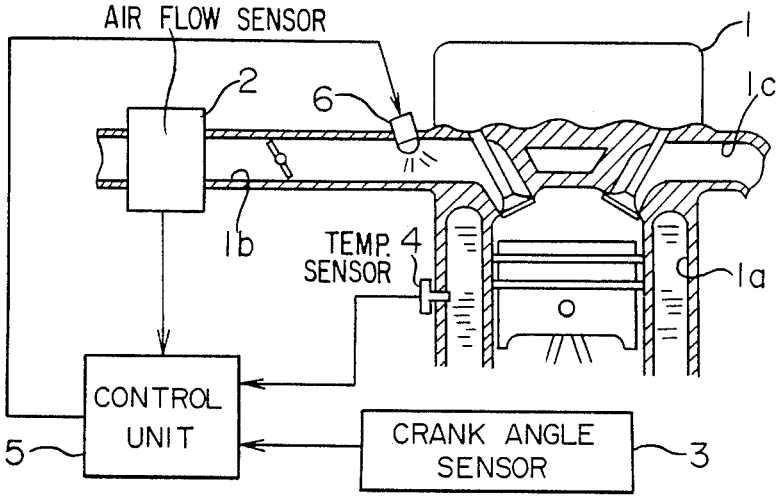
FIG. 1 PRIOR ART
FIG. 1 is a schematic view showing the general arrangement of an engine control device for a vehicle.
Figure 2:
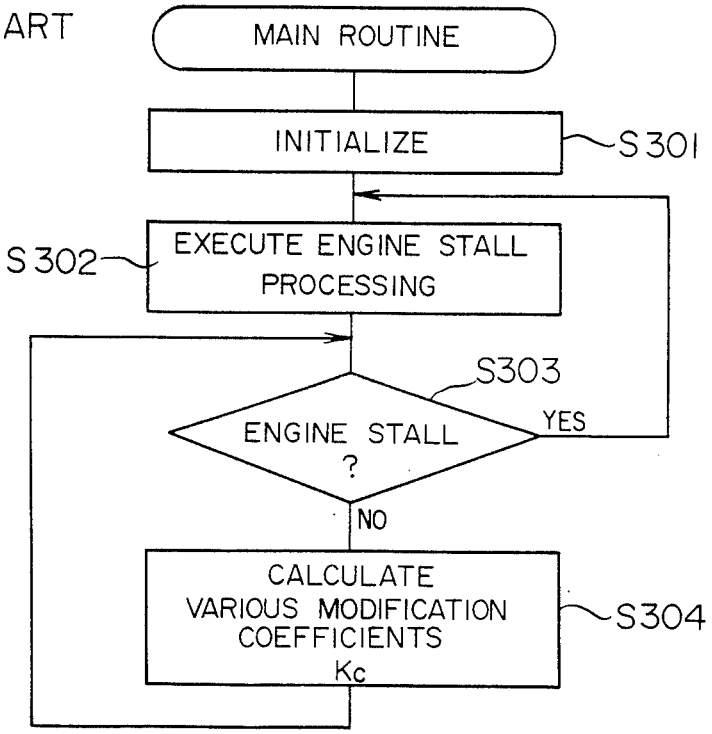
FIG. 2 PRIOR ART
FIG. 2 is a flow chart showing a main routine executed by the engine control device of FIG. 1 in accordance with a conventional engine control method.
Figure 4:
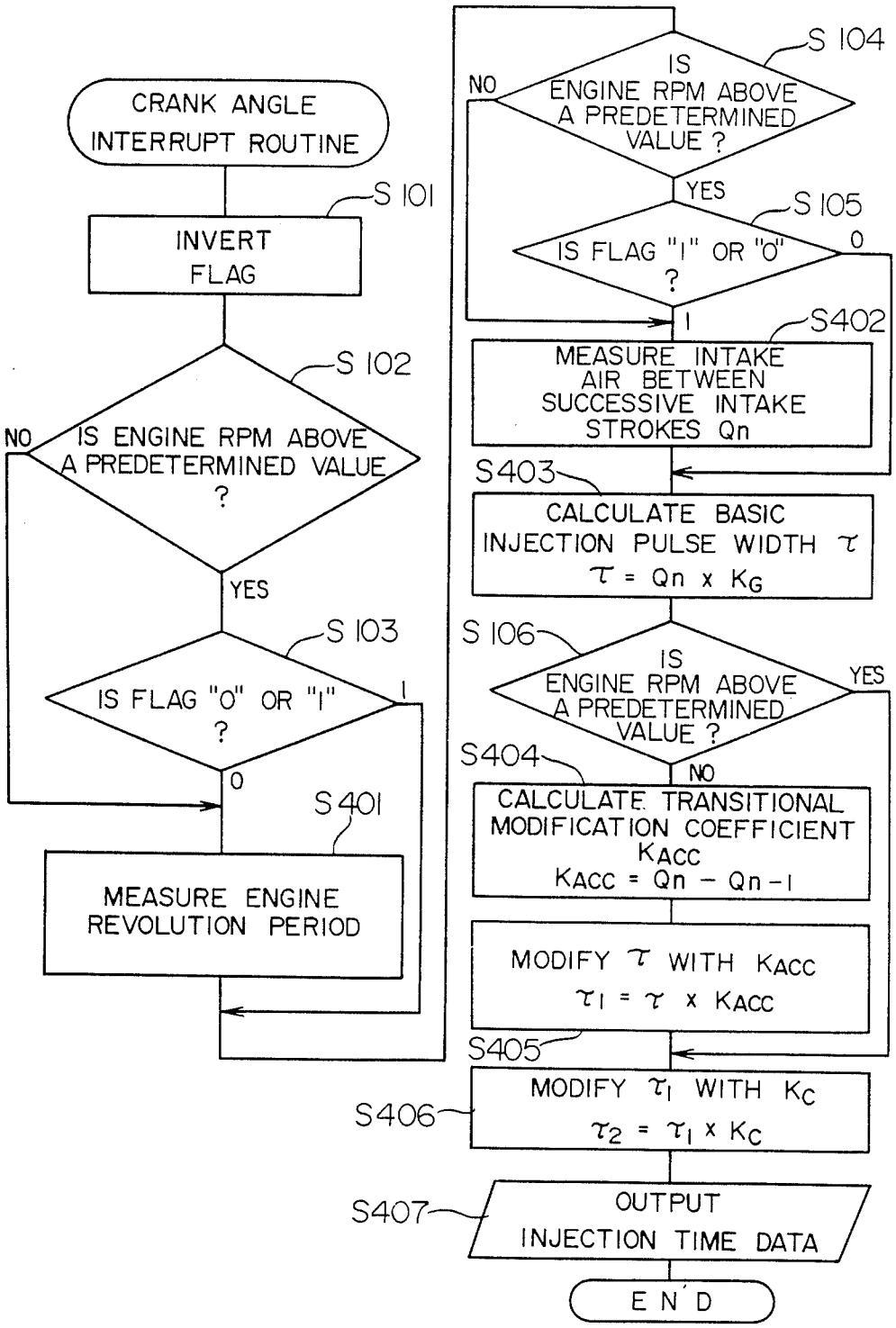
FIG. 4 is a flow chart showing a crank angle interrupt routine in accordance with one embodiment of an engine control method of the present invention.

Referring first to FIG. 4, there is shown an interrupt routine in the form of a crank angle interrupt routine of an engine control method in accordance with one embodiment of the present invention. In this embodiment, the general construction of the engine and a main control routine therefor are the same as those of the previously described prior art illustrated in FIGS. 1 and 2. As illustrated in FIG. 4, this crank angle interrupt routine is executed by a crank angle signal which is generated by a crank angle sensor in synchronization with a predetermined crank angle of the engine, i.e., when the engine takes the predetermined crank angle. Specifically, in Step S101, a flag for alternate judgement is inverted into "0" or "1" every time the crank angle interrupt routine is performed for determining which measurement of the period of successive intake strokes (Step S401) or the interstroke intake air amount (Step S402) is taken. After inversion of the alternate judgement flag, the control process proceeds to Step S102 wherein engine RPM judgement is made, i.e., it is judged whether or not an engine operating parameter shown as the RPM of the engine is in a specified operating range shown as being above a predetermined level. If not, the control process passes judgement of the flag in Step S103 and skips to a step of measuring engine revolution period shown as Step S401 wherein the period between successive crank angle signals is measured. On the other hand, if the engine RPM is judged to be above the predetermined level in Step S102, that is if variations in engine operating conditions are limited, the process proceeds to Step S103 wherein it is judged whether the flag is "0" or "1". If the flag is judged to be "0", then the period between the successive crank angle signals or the engine revolution period is measured in Step S401, whereas if the flag is judged to be "1", the process passes Step S401. The results of measurement in Step S401 are used as engine RPM information. In this regard, it is to be noted that if the engine RPM is above the predetermined level, the measurement of the engine revolution period is performed every two periods so that the result of the measurement obtained in Step S401 is doubled to provide an exact period data representative of engine revolution periods. Thereafter, the process proceeds to Step S104 wherein it is judged again whether or not the engine RPM is above the predetermined level, and if not, the process passes judgement of the flag in Step S105 and skips into a step of measuring interstroke intake air shown as Step S402 wherein the amount of intake air between the successive intake strokes is measured. On the other hand, if the engine RPM is judged to be above the predetermined level in Step S104, then judgement of the flag is made in Step S105. If the flag is "1", the measurement of interstroke intake air is carried out in Step S402, whereas if the flag is "0", the process passes Step S402. That is, the measurement of period of crank angle signals and the measurement of interstroke intake air are carried out every crank angle interrupt routine if the engine RPM is equal to or below the predetermined level, whereas these measurements are carried out alternately every other crank angle interrupt routine if the engine RPM is above the predetermined level. Also, in Step S402, the amount of intake air $Q_n$ sucked into the engine between the successive intake strokes or between crank angle signals is measured. In this case, if a Karman's air flow sensor is used for example, the interstroke intake air amount $Q_n$ is indicated by the number of pulses between the successive intake strokes. In this connection, since the measurement of interstroke intake air amount is taken every two crank angle signals when the engine RPM is above the predetermined level, a half of the amount of intake air thus measured in Step S402 is treated as an interstroke intake air amount $Q_n$.

Figure 3:
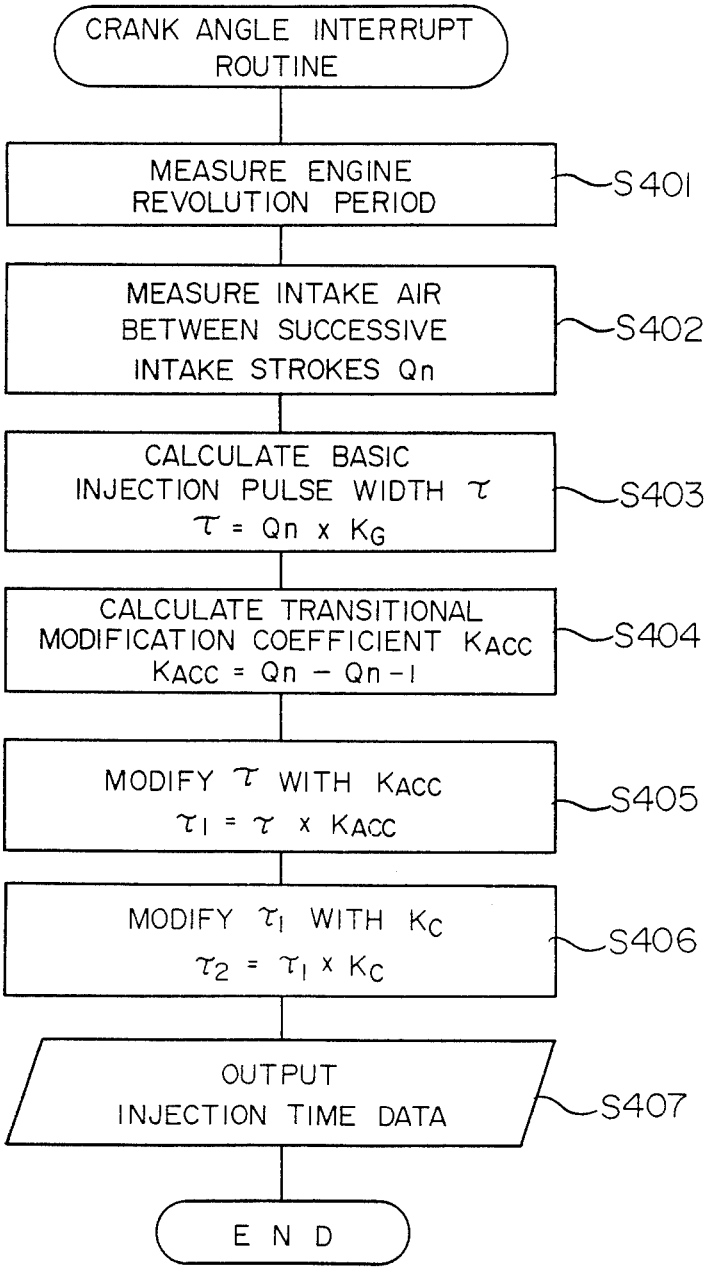
FIG. 3 PRIOR ART
FIG. 3 is a flow chart showing a crank angle interrupt routine executed by the engine control device of FIG. 1 in accordance with the conventional engine control method.

Subsequently, in Step S403, a basic fuel injection pulse width $\tau$ for determining a basic fuel injection amount corresponding to the interstroke intake air amount $Q_n$ is calculated as follows:

$$\tau = Q_n \times K_G$$

where $K_G$ is a constant which is determined by the injecton pulse width versus fuel injection amount characteristic of the engine. In the event that the measurement of intake air is not carried out in the present crank angle interrupt routine because of the engine RPM being above the predetermined level, the preceding intake air amount as measured in the preceding crank angle interrupt routine is used. Then, in Step S106, similar to Steps S102 and S104, it is judged again whether or not the engine RPM is above the predetermined level. If not, calculation of a transitional modification coefficient $K_{ACC}$ and transitional modification of the basic pulse width $\tau$ are carried out in Steps S404 and S405, respectively, as in those Steps of FIG. 3. On the other hand, if the engine RPM is judged to be above the predetermined level, the process passes Steps S404 and S405 and skips to Step S406.

The transitional modification is performed in order to supplement fuel shortage resulting from transitional operation of the engine. To this end, in Step S404, the transitional modification coefficient $K_{ACC}$ is calculated based on a change in the successive interstroke intake air amounts $Q_n - Q_{n-1}$, and then a transitionally modified injection pulse width $\tau_1$ is determined by multiplying the basic pulse width with the transitional modification coefficient $K_{ACC}$.

In Step S406, various modifications are carried out. Namely, when the process skips from Step S106 to Step S406, that is, when the engine RPM is above the predetermined level, the basic injection pulse width $\tau$ calculated in Step S403 is modified based on other modification factors representing engine operating conditions, i.e., by multiplying $\tau$ with various modification coefficients $K_C$. On the other hand, when the process proceeds from Step S106 to Step S406 through Steps S404 and S405, that is when the engine RPM is equal to or below the predetermined level, the transitionally modified injection pulse width $\tau_1$ calculated in Step S405 is further modified based on other factors representing engine operating conditions, i.e., by multiplying $\tau_1$ with various modification coefficients $K_C$. Finally, in Step S407, the fuel injection pulse width $\tau_2$ obtained in Step S406 is output as an injector drive signal to a fuel injector so that fuel is injected from the fuel injector into the intake passage of the engine at an amount which is determined by the fuel injection pulse width $\tau_2$. In this manner, the entire process of the crank angle interrupt routine ends.

As apparent from FIG. 4, in the low RPM range of the engine in which variations in the RPM and the interstroke intake air amount are relatively great, both of the period between successive crank angle signals (crank angle signal period) and the interstroke intake air amount are measured every crank angle signal interruption, and a transitional modification is carried out based on the variation in the interstroke amount of intake air thus measured. On the other hand, in the high RPM range in which there are little or almost no variations in the RPM and the interstroke amount of intake air, the crank angle signal period and the interstroke intake air amount are alternately measured every other crank angle signal interruption, and no transitional modification with the interstroke intake air amount is made because there is no need for such a transitional modification.

Figure 5:
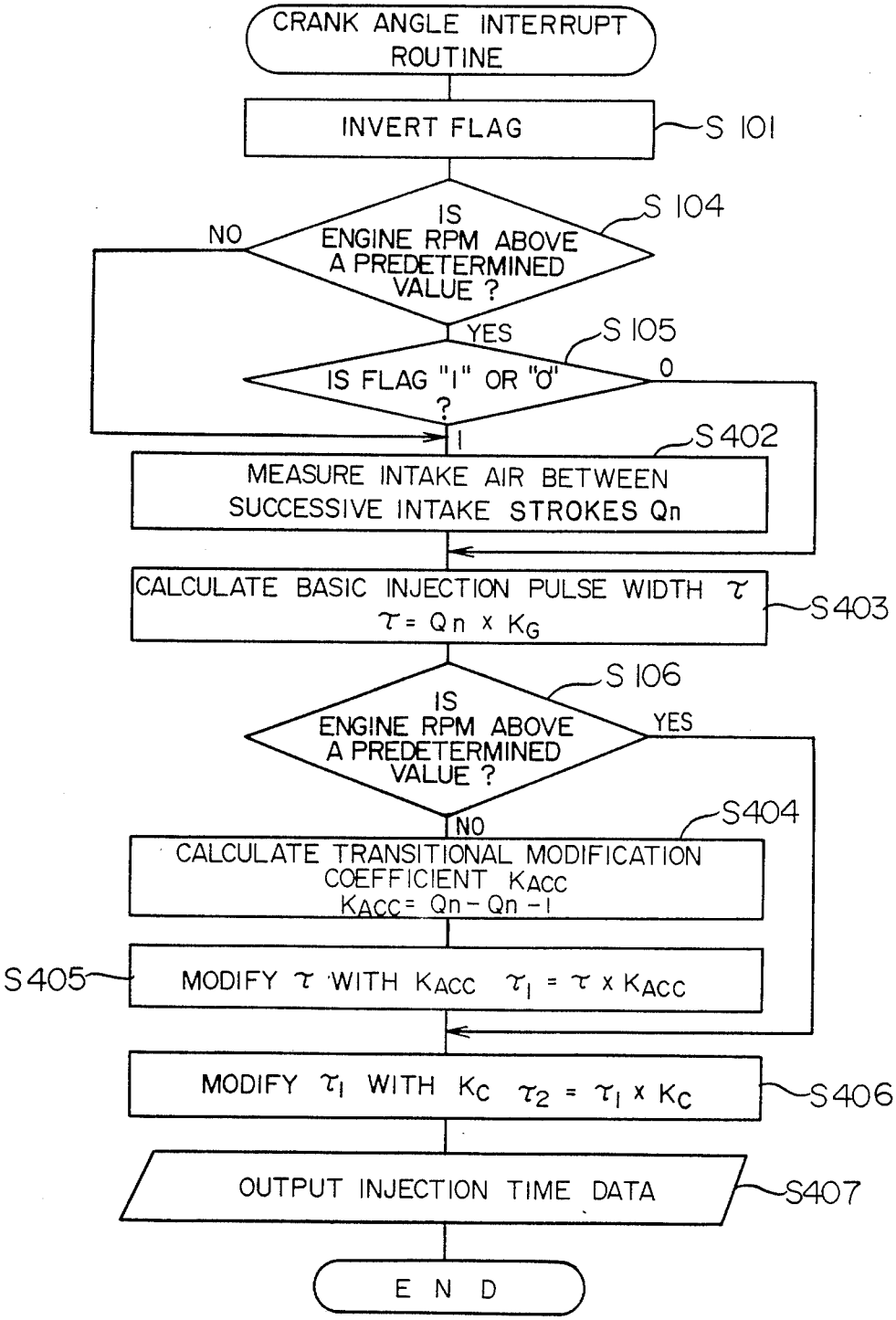
FIG. 5 is a flow chart showing a crank angle interrupt routine in accordance with another embodiment of an engine control method of the present invention.

FIG. 5 shows another embodiment of the present invention. This embodiment differs from the previous embodiment illustrated in FIG. 4 in that Steps S102, S103 and S401 of FIG. 4 are omitted to simplify the processing of the crank angle interrupt routine, thereby shortening the processing time required. In this embodiment, measurement of the engine revolution period as in Step S401 of FIG. 4 is not performed and hence judgement of the engine RPM and judgement of the flag as in Steps S102 and S401 of FIG. 4 are unnecessary. Thus, when the engine RPM is above the predetermined level, i.e., when variations in engine operating conditions are limited, a step of measuring interstroke intake air shown as Step S402, measurement of intake air, is partially omitted or performed every two crank angle interrupt timings. The remaining Steps of this embodiment are the same as those of the previous embodiment of FIG. 4.

It is to be noted that a portion or some of the calculation of various modification coefficient calculations in the main routine may of course be alternately processed or partially omitted as necessary, and a plurality of engine controls other than fuel injection control which are usually effected simultaneously can also be processed in an alternate manner or omitted partially every specified timing as far as there will be no resulting problem in actual engine operation. Further, such a specified alternate or omitting processing timing is not limited to every crank angle signal timing but may be every two or more crank angle signals, or at every predetermined time interval, or every predetermined number of processings of the main routine. Furthermore, although in the above-described embodiments, the alternate or omitting processings are carried out when the RPM of the engine is above a predetermined level, such alternate or omitting processings may be performed when engine load is above a predetermined level, i.e., when the interstroke amount of intake air is above a predetermined level.

As described above, according to this embodiment, in the engine operating range in which variations in engine operating conditions are relatively dull or limited, processing of the output signals of various sensors is not carried out every processing or interruption timing but alternately or omitted partially as desired so that any substantial increase in processing time during high engine RPM can be avoided, thereby preventing resultant instability in fuel injection timing and delay in various modifications. Accordingly, it is possible to realize optimal engine control in substantially entire operating range of the engine.

We claim:

1. An engine control method for a vehicle comprising:

sensing operating conditions of an engine through the use of various sensors, establishing from the sensed operating conditions whether the engine is operating within a specified operating range in which variations in the sensed operating conditions of the engine are limited, calculating a fuel injection pulse width based on the sensed engine operating conditions in a plurality of steps including a step of measuring engine revolution period and a step of measuring interstroke intake air through the use of a microcomputer, optimizing operation of the engine by use of the fuel injection pulse width thus calculated, calculating the steps of measuring engine revolution period and interstroke intake air every time the fuel injection pulse width is calculated while the engine operates outside the specified operating range, and alternately calculating and omitting the step of measuring engine revolution period and the step of measuring interstroke intake air every other time the fuel injection pulse width is calculated while the engine operates in the specified operating range.

2. An engine control method for a vehicle as claimed in claim 1 wherein the specified operating range is a range in which the engine speed in revolutions per minute is above a predetermined level.

3. An engine control method for a vehicle as claimed in claim 2 wherein said plurality of steps are carried out in an interrupt routine executed when the microcomputer is interrupted.

4. An engine control method for a vehicle as claimed in claim 1, wherein the specified operating range of the engine is a range in which engine load is above a predetermined level.

5. An engine control method for a vehicle as claimed in claim 4 wherein said plurality of steps are carried out in an interrupt routine executed when the microcomputer is interrupted.

6. An engine control method for a vehicle as claimed in claim 1 wherein said plurality of steps are carried out in an interrupt routine executed when the microcomputer is interrupted.

7. An engine control method for a vehicle as claimed in claim 6 wherein the interrupt routine is a crank angle interrupt routine in which interrupt processing is performed when the engine takes a certain crank angle.

8. An engine control method for a vehicle as claimed in claim 7 wherein the crank angle interrupt routine comprises:

sensing engine crank angle and generating a crank angle signal at an instant when the engine takes a predetermined crank angle;

measuring a period of revolution of the engine and measuring amounts of intake air sucked into the engine between successive intake strokes while the engine operates outside the specified operating range;

alternately measuring the period of revolution of the engine to obtain engine operating range information and measuring amounts of intake air sucked into the engine between successive intake strokes while the engine operates in the specified operating range;

calculating a fuel injection pulse width based on the measured intake air amounts for controlling the operation of the engine;

calculating a coefficient of transitional modification based on successively measured intake air amounts only when the engine is in the specified operating range;

modifying the fuel injection pulse width with the coefficient of transitional modification only when the engine is in the specified operating range;

further modifying the transitionally modified fuel injection pulse width with other modifying coefficients; and controlling the operation of the engine in accordance with the further modified fuel injection pulse width.

9. An engine control method for a vehicle comprising:

sensing operating conditions of an engine through the use of various sensors, establishing from the sensed operating conditions whether the engine is operating within a specified operating range in which variations in the sensed operating conditions of the engine are limited, calculating a fuel injection pulse width based on the sensed engine operating conditions in a plurality of steps including a step of measuring interstroke intake air through the use of a microcomputer, optimizing operation of the engine by use of the fuel injection pulse width thus calculated, calculating the step of measuring interstroke intake air every time the fuel injection pulse width is calculated while the engine operates outside the specified operating range, and alternatively calculating and omitting the step of measuring interstroke intake air every other time the fuel injection pulse width is calculated while the engine operates in the specified operating range.

10. An engine control method for a vehicle as claimed in claim 9 wherein the specified operating range of the engine is a range in which engine speed in revolutions per minute is above a predetermined level.

11. An engine control method for a vehicle as claimed in claim 10 wherein said plurality of steps are carried out in an interrupt routine executed when the microcomputer is interrupted.

12. An engine control method for a vehicle as claimed in claim 9 wherein specified operating range of engine is a range in which engine load is above a predetermined level.

13. An engine control method for a vehicle as claimed in claim 12 wherein said plurality of steps are carried out in an interrupt routine executed when the microcomputer is interrupted.

14. An engine control method for a vehicle as claimed in claim 9 wherein said plurality of steps are carried out in an interrupt routine executed when the microcomputer is interrupted.

15. An engine control method for a vehicle as claimed in claim 14, wherein the interrupt routine ia a crank angle interrupt routine in which interrupt processing is performed when the engine takes a certain crank angle.

16. An engine control method for a vehicle as claimed in claim 15 wherein the crank angle interrupt routine comprises:

sensing engine crank angle and generating a crank angle signal at an instant when the engine takes a predetermined crank angle;

measuring amounts of intake air sucked into the engine between successive intake strokes every time the crank angle interrupt routine is executed while the engine operates outside the specified operating range;

measuring amounts of intake air sucked into the engine between successive intake strokes every other time the crank angle interrupt routine is executed while the engine operates in the specified operating range;

calculating a fuel injection pulse width based on the measured intake air amounts for controlling the operation of the engine;

calculating a coefficient of transitional modification based on successively measured intake air amounts only when the engine is in the specified operating range;

modifying the fuel injection pulse width with the coefficient of transitional modification only when the engine is in the specified operating range;

further modifying the transitionally modified fuel injection pulse width with other modifying coefficients; and controlling the operation of the engine in accordance with the further modified fuel injection pulse width.

* * * * *